US008495780B2

(12) United States Patent
Back

(10) Patent No.: US 8,495,780 B2
(45) Date of Patent: Jul. 30, 2013

(54) APPARATUS FOR SHINING SHOES

(76) Inventor: Joung-Moon Back, Seoul (KR)

( * ) Notice: Subject to any disclaimer, the term of this patent is extended or adjusted under 35 U.S.C. 154(b) by 341 days.

(21) Appl. No.: 12/890,952

(22) Filed: Sep. 27, 2010

(65) Prior Publication Data

US 2011/0197380 A1 Aug. 18, 2011

(30) Foreign Application Priority Data

Feb. 12, 2010 (KR) ..... 10-2010-0013533

(51) Int. Cl.
*A47L 23/02* (2006.01)

(52) U.S. Cl.
USPC ..... 15/31; 15/34; 15/97.2

(58) Field of Classification Search
USPC ..... 15/30–37, 97.2
IPC ..... A47L 23/00,23/02, 23/22
See application file for complete search history.

(56) References Cited

U.S. PATENT DOCUMENTS

| | | | | | |
|---|---|---|---|---|---|
| 997,113 | A | * | 7/1911 | Campbell | 15/33 |
| 1,032,866 | A | * | 7/1912 | Smith | 15/32 |
| 1,264,279 | A | * | 4/1918 | Daly et al. | 15/97.2 |
| 1,493,162 | A | * | 5/1924 | Ringstrom et al. | 15/32 |
| 1,539,013 | A | * | 5/1925 | Lightsey | 15/97.2 |
| 1,551,387 | A | * | 8/1925 | Gross | 15/97.2 |
| 1,648,578 | A | * | 11/1927 | Croy | 15/30 |
| 1,774,576 | A | * | 9/1930 | Uden | 15/97.2 |
| 1,953,376 | A | * | 4/1934 | Uden | 118/323 |
| 2,283,063 | A | * | 5/1942 | Heuver | 15/97.2 |
| 2,589,785 | A | * | 3/1952 | Edington | 194/316 |
| 2,769,993 | A | * | 11/1956 | Fernandez | 15/97.2 |
| 2,818,589 | A | * | 1/1958 | Carter | 15/31 |
| 3,309,726 | A | * | 3/1967 | Moore et al. | 15/32 |
| 3,325,843 | A | * | 6/1967 | Dreibholz | 15/31 |
| 3,557,928 | A | * | 1/1971 | Cromwell et al. | 194/241 |
| 3,737,942 | A | * | 6/1973 | Casey | 15/339 |
| 3,787,918 | A | * | 1/1974 | Ebert | 15/31 |
| 7,036,178 | B1 | * | 5/2006 | Sigrist | 15/34 |
| 2010/0306935 | A1 | * | 12/2010 | De Florian et al. | 15/30 |
| 2011/0252585 | A1 | * | 10/2011 | Lee | 15/30 |

FOREIGN PATENT DOCUMENTS

| | | | |
|---|---|---|---|
| JP | 04092637 | A * | 3/1992 |
| JP | 06113995 | A * | 4/1994 |
| JP | 08117179 | A * | 5/1996 |
| JP | 09098935 | A * | 4/1997 |

* cited by examiner

*Primary Examiner* — Joseph J Hail
*Assistant Examiner* — Marc Carlson
(74) *Attorney, Agent, or Firm* — Sherr & Jiang, PLLC

(57) ABSTRACT

An apparatus for shining shoes is provided in which an oil shoe polish containing 5~20 volume % of an oil ingredient is substantially coated on a shoe surface by using a rotating sponge and is maintained for a certain time period under a high temperature environment of above 60° C. by introducing a heat wind, so that it is possible to obtain an excellent shoe shining effect similar to that of a manual shoe shining work or a higher shoe shining effect than the same.

9 Claims, 3 Drawing Sheets

APPARATUS FOR SHINING SHOES

CROSS REFERENCE

This application claims foreign priority under Paris Convention and 35 U.S.C. §119 to Korean Patent Application No. 10-2010-0013533, filed Feb. 12, 2010 with the Korean Intellectual Property Office.

BACKGROUND OF THE INVENTION

1. Technical Field

The present invention relates to an apparatus for shining shoes, and in particular to an apparatus for shining shoes in which an oil shoe polish containing 5~20 volume % of an oil ingredient is substantially coated on a shoe surface by using a rotating sponge and is maintained for a certain time period under a high temperature environment of above 60° C. by introducing a heat wind, so that it is possible to obtain an excellent shoe shining effect similar to that of a manual shoe shining work or a higher shoe shining effect than the same.

2. Description of the Related Art

Generally, when shoes are dirty, a user might look dirty hurting ones dignity and others might hurt. In particular, when the surfaces of shoes are not protected by a shoe polish, the shoes might look defective and might not be waterproof, so the lifespan of shoes decrease.

When the shoes are coated by using a shoe polish, the shoes shine. In the past, the shoe shining work is almost performed by a manual work.

In recent years, an apparatus for shining shoes is developed for automatically shining shoes and is conveniently used. A liquid shoe polish is coated on the shoes, and a hair brush rotating at a high speed repeatedly makes a friction for thereby shining the shines.

The above conventional apparatus might provide a convenience and economic benefit, but the shining effect of shoes is bad, so that a user is not satisfied.

In view of the above problems, a liquid shoe polish is simply made by melting a solid shoe polish, which is widely used for a manual shoe shining work, by using ethyl alcohol and water, with the composition of the solid shoe shining polish being formed of wax (shining agent) and polymer emulsion and pigment. The shoe shining polish is coated on the surfaces of shoes, and a friction work is repeatedly performed by means of a hair brush rotating at a high speed, so that the shoe shining polish is uniformly coated on the shoes, but the shining quality is very bad.

Comparing to when shining by a manual work, even when a friction is repeatedly performed by using a shoe brush, it is impossible to enhance a shining effect, so the shining effect is bad.

In Korea, almost men consider that shining shoes do matter, and the preference of the shoe shining is determined depending on the shining degree of shoes. So, a poor shining effect of shoes means that a corresponding shoe shining apparatus does not have enough effects.

The method for obtaining a higher shining effect in the course of manual work is performed in such a manner that a shoe shining polish is uniformly coated on the surfaces of shoes by using a shoe brush, and the coated surfaces of the shoes are repeatedly rubbed by using a certain cloth. It is possible to perform the above work by using a machine, but it is almost impossible to manufacture such a machine for uniformly rubbing every corner of the shoes, and it takes long for shining shoes.

SUMMARY OF THE INVENTION

Accordingly, it is an object of the present invention to provide an apparatus for shining shoes which overcomes the problems encountered in the conventional art and which can obtain a desired shoe shining effect similar to when shined by a manual work or can obtain an excellent shoe shining effect.

The objects and various advantages of the present invention can be more clearly clarified by those skilled in the art and the following embodiments.

To achieve the above objects, there is provided an apparatus for shining shoes which comprises a casing 110 which forms a closed space in the same and includes a shoe input opening 112 formed at one side of the same and opened and closed; a shoe accommodating plate 130 which is provided in the interior of the casing 110 closer to the shoe input opening 112 for accommodating the shoe s; a forward and backward moving member 150 which automatically rotates receiving an oil shoe shining polish and has a center upper surface sponge roller 153 and left and right side surface sponge rollers 157-1 and 157-2 plane-disposed so as to coat left and right side surfaces and are configured to move forward and backward and are positioned at a rear side spaced apart from the shoe accommodating plate 130 at an initial stage and moves forwards once and then moves backwards; a running driving means 160 which moves the forward and backward running member 150 in forward and backward directions; a shoe shining polish supply means 180 which stores the oil shoe shining polish and supplies to the center upper surface sponge roller 153 and the left and right side surface sponge roller 157-1, 157-2; a high temperature air supply means 190 which heats external air inputted via an air inlet 114 formed at one side of the casing 110 for thereby producing heated air and transfers the same and sprays the heated air toward the front upper surface and left and right sides of the shoes s by using a spraying nozzle 198*a*; a temperature measuring means 200 which is engaged in the casing 110 and measures an inner temperature and transmits the same; a temperature control unit which controls so that an inner temperature measured by the temperature measuring means 200 can maintain within a set temperature range; a control panel 210 which performs the whole operation controls by receiving a user's instruction and performs a heating operation for a set time; and a curtain means 214 in which the center upper surface sponge roller 153 and the left and right side surface sponge rollers 157-1 and 157-2 coat the oil shoe shining polish on the shoes s accommodated in the shoe accommodating plate 130, with the curtain means being vertically positioned at a back portion closer to the shoe accommodating plate 130 at the time when it escapes from the shoes s for thereby closing the inner space, so that the heating by the heated air can be efficiently performed.

There are further provided a shoe detection means 140 for detecting whether or not the shoe s is accommodated on the shoe accommodating plate 130; and a running guide means 170 which engages the forward and backward running member 150 on an upper side and has a forward and backward guide rod 170*a* longitudinally formed at both sides in forward and backward directions for guiding the forward and backward movements of the forward and backward running member 150, with the forward and backward running member 150 being equipped with an upright cover member 151 in which the center upper surface sponge roller 153 being rotatable in left and right directions at the upper lower end in an angle shape of which a lower end is hinged to be rotatable in forward and backward directions, with the first rotation motor 154 being engaged at one side of the center upper surface sponge roller 153, with the upright cover member 151 being elastically supported by means of two springs 152-1 and 152-2 in forward and backward directions; and left and right arm members 155-1 and 155-2 which are longitudinally provided at left and right sides in forward and backward directions, with their rear ends being freely rotatable in left and right directions, with the left and right side surface sponge rollers 157-1 and 157-2 being vertically rotatable at the front side end, with the second rotation motors 158-1 and 158-2 being engaged at the lower sides of the left and right side surface sponge rollers 157-1 and 157-2, with the side cover members 159-1 and 159-2 being provided at the outer sides of the left and right side surface sponge rollers 157-1 and 157-2, and with the left and right arm members 155-1 and 155-2 being elastically supported by means of two springs 156-1 and 156-2.

The shoe shining polish supply means 180 includes a shoe shining polish storing container 182 which stores an oil shoe shining polish and has a pumping means 182*a* for pumping the oil shoe shining liquid; a pumping operation means 184 for operating the pumping means 182*a* of the shoe shining storing container 182; and a shoe shining transfer line 186 which is branched into three parts at its intermediate portion for thereby supplying the oil shoe shining polish pumped from the shoe shining storing container 182 into the interior of the oil shining polish and toward the center upper surface sponge roller 153 and the left and right side surface sponge rollers 157-1 and 157-2, respectively.

The high temperature air supply means 190 includes a suction fan 192 which is provided in an inner side of the air inlet port 114 of the casing 110 for forcibly sucking an external air; an air transfer tube 194 for transferring the air sucked by the suction fan 192 into the inner side; a heating coil member 196 which is provided in a coil shape surrounding an outer side of the air transfer tube 194 for resistant-heating depending on a power supply; and a high temperature air transfer tube 198 which is longitudinally extended from the air transfer tube 194 and is branched into three parts at an intermediate portion for transferring a high temperature air into an inner side while distributing a high temperature air via the spray nozzle 198*a* from the front upper side and the left and right sides of the shoes s.

The oil ingredient is one among mink oil, castor bean oil and jojoba oil or a combination of the same.

There is further provided a shoe shape member f which is formed in a shape of a human foot and is inserted into the interior of the shoe s and is heated so that an original shape of the shoe s is recovered.

After the oil shoe shining polish is coated, the first coated oil shoe shining polish is heated and dried by means of a high temperature air, and the oil shoe shining polish is coated second, and the second coated shoe shining polish is heated and dried by the high temperature air.

According to the present invention, the oil shoe shining polish mixed with 5~20 volume % of oil ingredient is substantially coated by using a rotating sponge and is shined by processing the same under a high temperature environment of 60~80° C. kept by means of heated air for 3 to 10 minutes. The obtained shining quality is similar with the manual shining work or is better than the same, so that a user can be fully satisfied.

BRIEF DESCRIPTION OF THE DRAWINGS

The present invention will become better understood with reference to the accompanying drawings which are given only by way of illustration and thus are not limitative of the present invention, wherein.

DETAILED DESCRIPTION OF THE INVENTION

The preferred embodiments of the present invention will be described with reference to the accommodating drawings.

Figure 1:
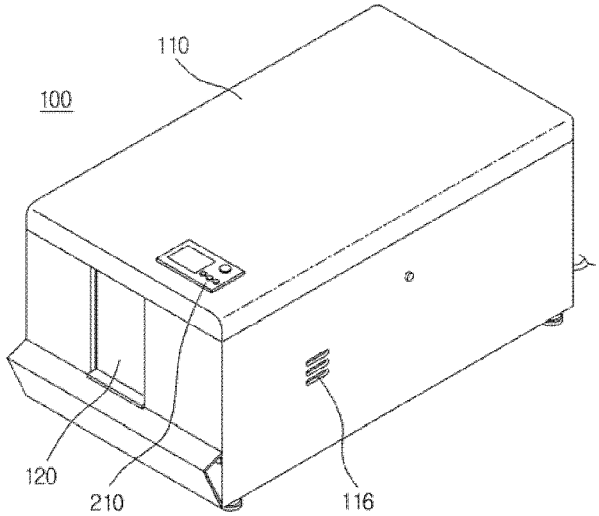
FIG. 1 is a schematic perspective view illustrating an outer look of a shoe shining apparatus according to a preferred embodiment of the present invention.
Figure 2:
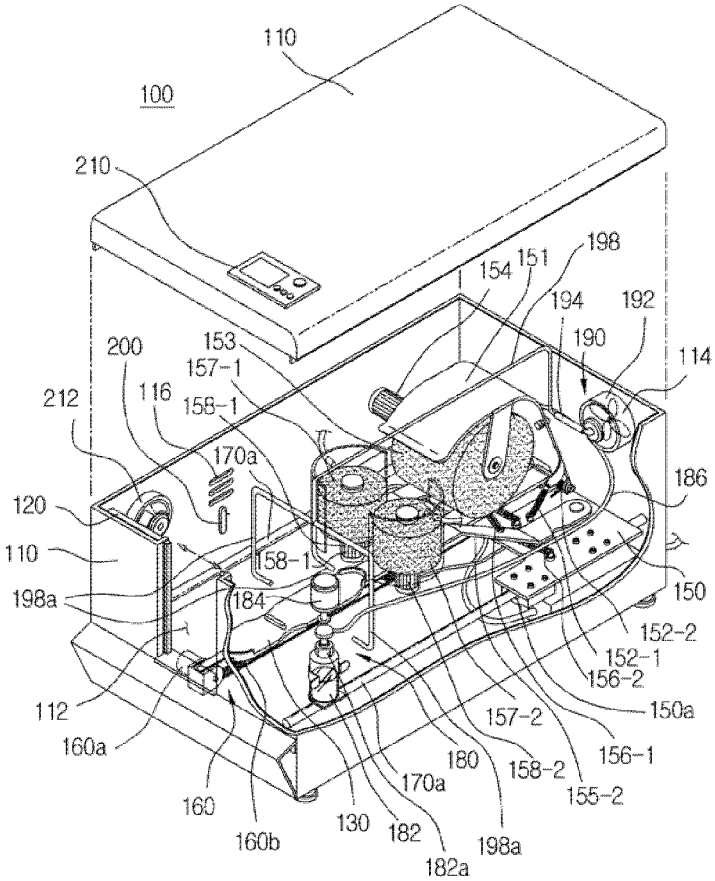
FIG. 2 is a perspective view illustrating an inner apparatus unit of a shoe shining apparatus according to a preferred embodiment of the present invention.
Figure 3:
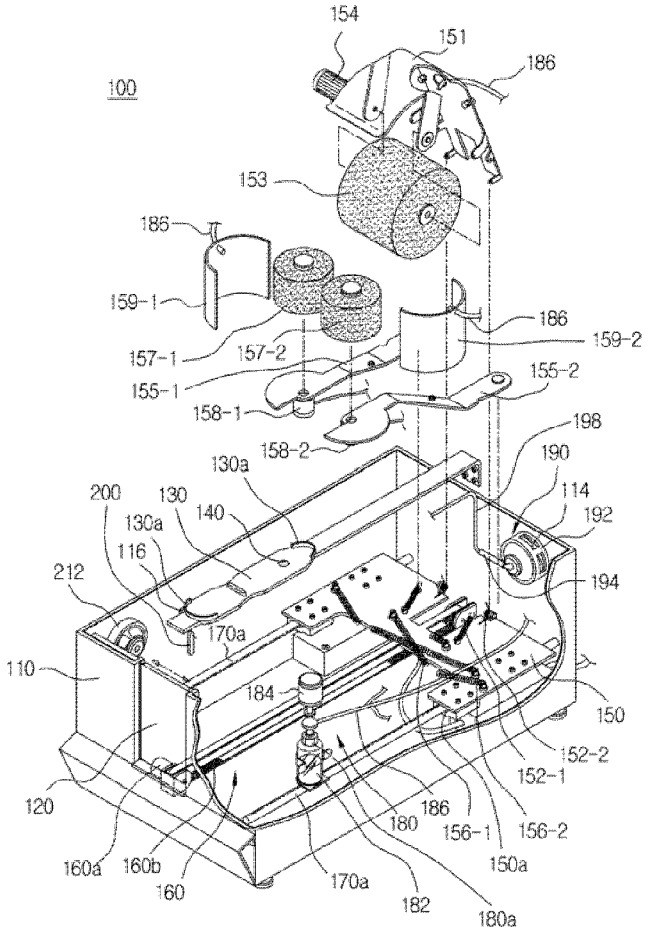
FIG. 3 is a disassembled perspective view illustrating an inner apparatus unit of a shoe shining apparatus according to a preferred embodiment of the present invention.
Figure 4:
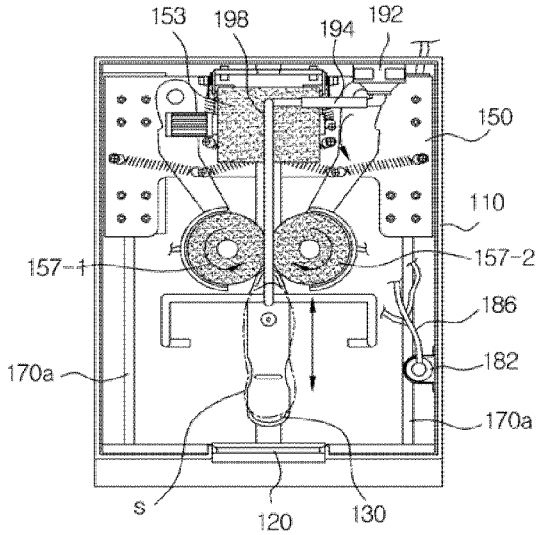
FIG. 4 is a view illustrating part of the operation of a shoe shining apparatus according to a preferred embodiment of the present invention.

FIG. 1 is a schematic perspective view illustrating an outer look of a shoe shining apparatus according to a preferred embodiment of the present invention. FIG. 2 is a perspective view illustrating an inner apparatus unit of a shoe shining apparatus according to a preferred embodiment of the present invention. FIG. 3 is a disassembled perspective view illustrating an inner apparatus unit of a shoe shining apparatus according to a preferred embodiment of the present invention;

The shinning principle adapted to the shoe shining apparatus 100 according to the present invention is characterized in that an oil ingredient of mink oil, castor bean oil, jojoba oil or the like is mixed by 5~20 volume % with a conventional shoe shining polish for thereby manufacturing an oil shining polish according to the present invention. The oil shining polish is applied to a sponge, and the surfaces of the shoe is uniformly coated by using the sponge and is maintained for 3~10 minutes under a high tem environment of 60~80° C. for thereby obtaining a quality shinning effect.

The shining quality is similar with the quality obtained by using a cloth and a burning work or a water shining effect or is better than the same. So, in the present invention, it is possible to obtain a very quality shining effect unlike a shoe that is simply shined by oil or a disposable liquid type shining polish.

At this time, a heating source like a heater might be disposed below the surface of the shoe for directly heating the same. In this case, the bonded portions of the shoes might be damaged. So, it is needed to dispose the shoes in the closed space with heated air for thereby preventing the shoes from being damaged and obtaining a direct heating operation.

In the present invention, it is not needed to physically repeat a friction work after applying a shoe shining polish like in the conventional art. Only the oil shoe polish is uniformly applied on the surfaces of the shoes for thereby uniformly coating. In the present invention, the sponge is used instead of a hair brush. The sponge absorbs oil shoe shining polish and transfers the same onto the surfaces of the shoe for thereby obtaining a full coating effect.

In more details, an apparatus for shining shoes according to the present invention comprises a casing 110 which forms a closed space in the same and includes a shoe input opening 112 formed at one side of the same and opened and closed; a shoe accommodating plate 130 which is provided in the interior of the casing 110 closer to the shoe input opening 112 for accommodating the shoe s; a forward and backward moving member 150 which automatically rotates receiving an oil shoe shining polish and has a center upper surface sponge roller 153 and left and right side surface sponge rollers 157-1 and 157-2 plane-disposed so as to coat left and right side surfaces and are configured to move forward and backward and are positioned at a rear side spaced apart from the shoe accommodating plate 130 at an initial stage and moves forwards once and then moves backwards; a running driving means 160 which moves the forward and backward running member 150 in forward and backward directions; a shoe shining polish supply means 180 which stores the oil shoe shining polish and supplies to the center upper surface sponge roller 153 and the left and right side surface sponge roller 157-1, 157-2; a high temperature air supply means 190 which heats external air inputted via an air inlet 114 formed at one side of the casing 110 for thereby producing heated air and transfers the same and sprays the heated air toward the front upper surface and left and right sides of the shoes s by using a spraying nozzle 198*a*; a temperature measuring means 200 which is engaged in the casing 110 and measures an inner temperature and transmits the same; a temperature control unit which controls so that an inner temperature measured by the temperature measuring means 200 can maintain within a set temperature range; a control panel 210 which performs the whole operation controls by receiving a user's instruction and performs a heating operation for a set time; and a curtain means 214 in which the center upper surface sponge roller 153 and the left and right side surface sponge rollers 157-1 and 157-2 coat the oil shoe shining polish on the shoes s accommodated in the shoe accommodating plate 130, with the curtain means being vertically positioned at a back portion closer to the shoe accommodating plate 130 at the time when it escapes from the shoes s for thereby closing the inner space, so that the heating by the heated air can be efficiently performed.

The casing 110 is formed of a closed space, and the shoe s is inserted into the closed space, and various apparatuses are provided for heating and drying the shoes coated with oil shoe shining polish. The closed space maintains a high temperature environment.

The shoe input port 112 passes through the front side of the casing 110, and the shoe s is inputted through the shoe input port 11, and the shoe s is discharged after finishing a shining work.

The shoe input port 112 is closed by means of the opening and closing door 120. When the shoe s is inputted or discharged, the opening and closing door 120 is opened, and it is closed in the course of operation.

The air input port 114 is formed at one side of the casing 110 for receiving an external air to be heated, and an air discharge port 116 is formed at the other side for discharging heated air.

It is preferred that the inner surfaces of the casing 110 are thermally insulated and soundproofed.

The shoe accommodating plate 130 is formed in a plane shape like the shoe. The height is step-shaped at the intermediate height to match with the stepped shape of the bottom of the shoe s while not interfering with the left and right side surface sponge rollers 157-1 and 157-2. The move prevention rim 130*a* is slightly protruded upwardly from the end in order to prevent the move of the accommodated shoe s.

The shoe shining apparatus 100 according to the present invention preferably starts operating when the shoe is accommodated in the shoe accommodating plate. For this operation, a shoe detection member 140 such as a sensor or a switch is needed. The shoe detection member 140 might be provided on the shoe accommodating plate 130 or a portion close to the same.

The forward and backward running member 150 is formed of a horizontal plate having a certain area and includes a center upper surface sponge roller 153 and left and right sponge rollers 157-1 and 157-2 which are disposed in plane.

At this time, the center upper surface sponge roller 153 and the left and right side surface sponge rollers 157-1 and 157-2 are formed in a triangle shape because the side of the shoe s contacting with the left and right side surface sponge rollers 157-1 and 157-2 is longer in the forward and backward directions, and the front upper surface of the shoe s contacting with the center upper surface sponge roller 153 is shorter in the forward and backward directions.

The center upper surface sponge roller 153 is horizontally engaged for easily coating the shoe shining polish with respect to the horizontal surface wider in the left and right directions, and the left and right side surface sponge rollers 157-1 and 157-2 are vertically engaged to match with the vertical surface wider in the upward and downward directions of the side of the shoe s.

The center upper surface sponge roller 153 is formed with the center portion being concaved for uniformly coating on the left and right end sides of the upper surface of the shoe s.

The center upper surface sponge roller 153 is rotatably engaged like being hanged at an upper lower end of the angled shape upright cover member 151 of which a lower end is hinged rotatable in the forward and backward directions with respect to the upper surface of the forward and backward running member 150.

In addition, a first rotation motor 154 is engaged at one side for rotating the center upper surface sponge roller 153.

When the center upper surface sponge roller 153 hanged at the upright cover member 151 is mounted on the front upper surface of the shoe s in the course of operation, the height of the center upper surface sponge roller 153 hanged as the upright cover member 151 is tilted slightly in backward direction is raised. When it is escaped from the front upper surface of the shoe s, the upright cover member 151 is slightly and freely tilted in a forward direction, so that the center upper surface sponge cover member 151 becomes closer with respect to the curved portion of the front side upper surface of the shoe with the help of the construction that the upright cover member 151 is elastically supported by means of two springs 152-1 and 152-2.

As shown in the drawings, there is provided a 1-1 spring 152-1 of which one end is engaged to the upper surface of the forward and backward running member 150 so that the upright cover member 151 can be pulled from the front lower side to the downward direction, and the other end is engaged at the height of the upright cover member 151, and there is provided a torsion spring type 1-2 spring 152-2 between the upper surface of the forward and backward running member 150 and the lower end of the upright cover member 151 in order to push the upright cover member 151 in the backward direction.

The upper end of the upright cover member 151 prevents the shoe shining polish from being externally splattered by closing the upper side of the center upper surface sponge roller 153 when the center upper surface sponge roller 153 rotates.

The rear ends of the left and right side surface sponge rollers 157-1 and 157-2 is freely rotatable with respect to the forward and backward running member 150 and are upright installed at the front ends of the left and right arm members 155-1 and 155-2 longitudinally disposed in the forward direction.

Here, since the left and right arm members 155-1 and 155-2 can freely rotate in the left and right directions, the left and right side surface sponge rollers 157-1 and 157-2 can move for thereby closely abutting with the side surfaces of the shoe s.

The left and right arm members 155-1 and 155-2 are elastically supported by means of two springs 156-1 and 156-2 so that the left and right side surface sponge rollers 157-1 and 157-2 engaged to the front sides of the left and right arm members 155-1 and 155-2 in the course of operation correspond to the side curved surfaces of the shoe s and are close to each other.

As shown in the drawings, there is provided a coil spring type 2-1 spring 156-1 so that each arm member 155-1 and 155-2 can be always pulled in the left direction, and a second rotation motor 158-1, 158-2 is engaged at a lower end of the same for rotating the left and right side surface sponge rollers 157-1 and 157-2.

Side cover members 159-1 and 159-2 are provided close to the left and right side surface sponge rollers 157-1 and 157-2 for thereby preventing the shoe shining polish from being spattered in the course of rotation.

Three sponge rollers 153, 157-1 and 157-2 are formed in such a manner that a sponge is engaged in the center portion in a ring shape.

Three sponge rollers 153, 157-1 and 157-2 take and apply oil shoe shining polish on the surfaces of the shoe s. When they rotate at too high speed, the oil shoe shining polish coated might be eccentric at one side while producing foams. So, it is preferred that they rotate at a lower speed.

The running driving member 160 generates a driving force for moving the forward and backward running member 150 in forward and backward directions in the course of operation.

A corresponding running driving member 160 includes a running driving motor 160*a* which can rotate in normal or reverse directions while generating a rotational force, and an endless orbit 160*b* which rotates based on an endless method depending on the rotation of the running driving motor 160*a* and is longitudinally disposed. The forward and backward running member 150 is engaged with respect to the endless orbit 160*b*, so that the forward and backward running member 150 can move forward or backward depending on the forward or backward movements of the endless orbit 160*b*.

At this time, the running distance can be determined by means of an operation control with respect to the running driving motor 160*a* or a separate limit sensor.

There might be further provided a running guide member 170 for engaging the forward and backward running member 150 to the upper side or for guiding the forward and backward movements of the same. The running guide member 170 might be formed of a forward and backward guide rod 170*a* which is engaged to a sliding engaging hole 150*a* passing through both sides of the forward and backward running member 150 in forward and backward directions.

The shoe shining polish supply member 180 stores oil shoe shining polish and supplies to three sponge rollers 153, 157-1 and 157-2 in the course of operation and includes a shoe shining polish storing container 182 having a pumping member 182*a* engaged in the interior of the casing 110 for pumping the stored oil shoe shining polish and supplying the same, a pumping operation member 184 which operates in accordance with an operation control of the control panel 210 like pressing the pumping member 182*a* of the shoe shining polish storing container 182 for thereby supplying the shoe shining polish, and a shoe shining polish transfer line 186 which transfers the shoe shining polish pumped from the shoe shining polish storing container 182 and is branched into three portions at an intermediate portion for thereby supplying shoe shining polish to three sponge rollers 153, 157-1 and 157-2.

The pumping operation member 184 and the pumping member 182*a* might be integrally formed.

The heated air supply member 190 forcibly sucks an external air from the air inlet port 114 formed at one side of the casing 110 and heats the same and sprays heated air to the shoe s.

Figure 5:
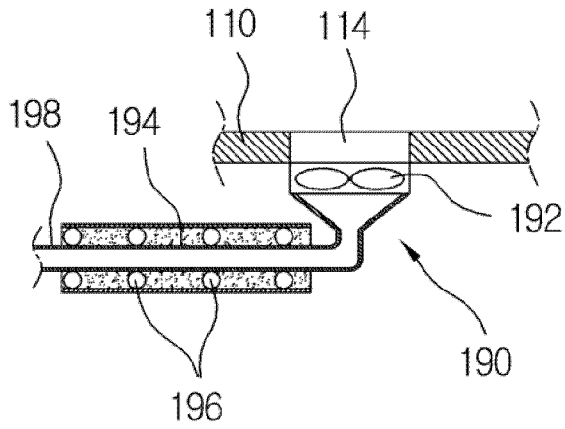
FIG. 5 is a view for describing a high temperature air generating part of a shoe shining apparatus according to a preferred embodiment of the present invention.

As shown in FIG. 5, the heated air supply member 190 includes a suction fan 192 provided in the inner side of the air inlet port 114 of the casing 110 for forcibly sucking an external air, an air transfer tube 194 for transferring the air sucked by means of the suction fan 192, a heating coil member 196 covering the air transfer tube 194 in a coil shape for thereby generating a resistant-based heating depending on the supply of power, and a heated air transfer tube 198 which is longitudinally extended from the air transfer tube 194 for transferring heated air to the interior and is branched into three parts for thereby distributing heated air through the spray nozzle 198*a* from the front upper side and the left and right sides of the shoe s.

The air transfer tube 194 is made of a material having an excellent thermal conduction ability.

The temperature measuring member 200 is disposed close to the shoe accommodating plate 130 in the interior of the casing 110 for thereby measuring and transferring the inner temperature.

The temperature control unit controls the power supplied to the heating coil member 196 so that the inner temperature measured by the temperature measuring member 200 can remain at 60~80° C.

The control panel 210 receives a user's instruction and performs the entire controls and performs heating for a set time.

The control panel 210 and the temperature control unit might be integrally formed.

As shown in the drawings, the shoe shining apparatus 100 according to the present invention is provided with a speaker member 212 for thereby informing an alarm message to the outside in the course of operation. In addition, the shoe shining apparatus 100 according to the present invention is equipped with a curtain member 214 so that it can be vertically positioned at a back portion close to the shoe accommodating plate 130 at the time when three sponge rollers 153, 157-1 and 157-2 coat oil shoe shining polish on the shoe s mounted on the shoe accommodating plate 130 and escape from the shoe s for thereby closing the inner space, whereby it is possible to minimize the heating space and perform heating fast (as shown in FIG. 6).

The curtain member 214 closes the inner space of the casing 110 at a desired position and separates into front and rear parts for thereby narrowing the space where the shoe accommodating plate 130 is positioned for thereby introducing the heated air with the narrowed space, so it is possible to heat fast, and an efficient heating operation can be performed.

When the curtain member 214 closes while avoiding any interference with other elements such as a forward and backward guide rod 170*a*, it does not need fully close. It can be configured to be closed as much as possible.

Figure 6:
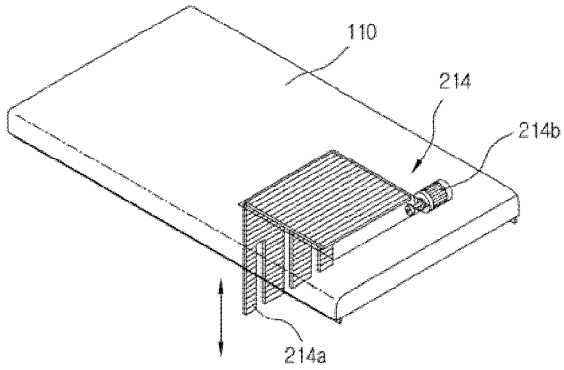
FIG. 6 is a view for describing a curtain member of a shoe shining apparatus according to an embodiment of the present invention.

The curtain member 214 is mechanically operated depending on the forward and backward operations of the forward and backward running member 150 and is closed and opened, but as shown in FIG. 6, the curtain 214*a* might be positioned at a lower surface of the upper plate of the casing 110 and separates the space as it is lowered by means of the operation of the curtain driving motor 214*b* and is moved up after being used. Namely, it might be configured like a conventional anti-criminal shutter.

Figure 7:
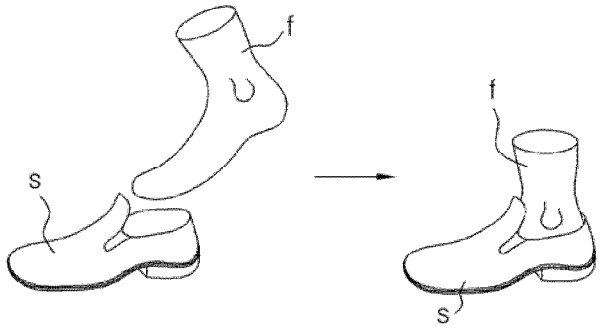
FIG. 7 is a view for describing a construction that a mannequin shoe is inserted into the interior of a shoe which is to be processed when using a shoe shining apparatus according to an embodiment of the present invention.

According to the present invention, there might be provided a certain additional recovery function for recovering the original shape of the shoe s transformed as heated air is supplied to the shoe s. At this time, as shown in FIG. 7, a foot shaped member f matching with the shape of mannequin might be inserted into the interior of the shoe s for more perfect recovery.

The operation of the shoe shining apparatus 100 according to the present invention will be described.

A user inserts a corresponding shoe s filled with the foot shaped member f into the interior via the shoe input port 112 and accommodates in the shoe accommodating plate 130.

The opening and closing door 120 is closed by a user's manual operation or in accordance with an operation control of the control panel 210.

As the first rotation motor 154 and the second rotation motors 158-1 and 158-2 operate, the sponge rollers 153, 157-1 and 157-2 rotate, and the pumping operation member 184 operates, and the oil shoe shining polish is supplied to the sponge rollers 153, 157-1 and 157-2, so that the running driving motor 160*a* operates, and the forward and backward running member 150 moves forward.

As the forward and backward running member 150 moves forward, the left and right side surface sponge rollers 157-1 and 157-2 contact with the sides of the shoe s for thereby first coating shoe shining polish, and the center upper surface sponge roller 153 contacts with the front upper side of the shoe s for thereby first applying shoe shining polish.

The forward and backward running member 150 moves backward and returns to its original position, and the running driving motor 160*a*, the first rotation motor 154, the second rotation motors 158-1 and 158-2 and the pumping operation member 184 properly stop.

The inner space is separated at an intermediate position by means of the curtain member 214, and the suction fan 192 and the heating coil member 196 operate for thereby generating heated air, so the heated air is sprayed into the inner space where the shoe s is positioned.

The temperature of the inner space where the shoe s is positioned is heated to 60~80° C. by means of the sprayed heated air and is maintained for 3~4 minutes, so that the first coated shoe shining polish is dried.

The curtain member 214 operates in reverse, and the inner spaces of both sides communicate with each other, and the first rotation motor 154, the second rotation motors 158-1 and 158-2, the pumping operation member 184 and the running driving motor 160*a* are operated, and the forward and backward running member 150 moves forward then backward, so that the shoe shining polish is applied to the surfaces of the shoe s.

The inner space is separated again at an intermediate portion by means of the curtain member 214, and the coated shoe is reheated at 60~80° C. for 3~4 minutes, so that the second coated shoe shining polish is dried.

All the processes are stopped, and all the works are stopped.

Thereafter, the opening and closing door 120 is opened, and the user picks up the shining shoe s.

The oil shoe shining polish is applied twice since the first coated oil shoe shining polish is fully absorbed into the shoe s, and then the second coated shoe shining polish has an excellent shining effect.

At this time, the second coating process is performed after the first coated oil shoe shining polish is fully dried. When the sponge rollers 153, 157-1 and 157-2 move for a second coating in a state that the first coated shoe shining polish is not fully dried, marks might remain.

The coating processes might be performed more than twice, which results in an excellent shining effect.

According to the present invention, since the shoes can be shined by a heating method by means of heated air along with a dedicated shoe shining polish, so the shining quality is similar with the manual shining work or more than the same.

The heating is performed by means of heated air, so it is possible to recover the original shape of the bent or transformed shoe s, and it is possible to kill bacteria for thereby obtaining a cleaning shoe shining effect.

The composition of the oil shoe shining polish used in the shoe shining apparatus 100 according to the present invention can be formed as follows.

TABLE 1

| Names of chemical substances | Remarks |
|---|---|
| Wax | |
| Polymer emulsion | |
| Ethyl alcohol | |
| Perfume | |
| $H_2O$ | |
| Dye | Black, brown, natural |
| Mink oil | Substitutable with Castor bean oil or jojoba oil |

As the present invention may be embodied in several forms without departing from the spirit or essential characteristics thereof, it should also be understood that the above-described examples are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

What is claimed is:

1. An apparatus for shining shoes, comprising:

a casing which forms a closed space in the casing and includes a shoe input opening formed at one side of the casing and opened and closed;

a shoe accommodating plate which is provided in an interior of the casing closer to the shoe input opening for accommodating the shoes;

a forward and backward moving member which has a center upper surface sponge roller and left and right side surface sponge rollers plane-disposed so as to coat left and right side surfaces and are configured to move forward and backward and are positioned at a rear side spaced apart from the shoe accommodating plate at an initial stage and moves forwards once and then moves backwards;

a running driving means which moves the forward and backward moving member in forward and backward directions;

a shoe shining polish supply means which stores an oil shoe shining polish and supplies to the center upper surface sponge roller and the left and right side surface sponge rollers;

a high temperature air supply means which heats external air inputted via an air inlet formed at one side of the casing for thereby producing heated air and transfers the heated air and sprays the heated air toward a front upper surface and left and right sides of the shoes by using a spraying nozzle;

a temperature measuring means which is engaged in the casing and measures an inner temperature;

a temperature control unit which controls so that an inner temperature measured by the temperature measuring means can maintain within a set temperature range;

a curtain means in which the center upper surface sponge roller and the left and right side surface sponge rollers coat the oil shoe shining polish on the shoes accommodated in the shoe accommodating plate, with the curtain means being vertically positioned at a back portion closer to the shoe accommodating plate at the time when it escapes from the shoes for thereby closing an inner space, so that the heating operation by the heated air can be efficiently performed; and a control panel formed on the casing for a user to control the apparatus for shining shoes.

2. The apparatus of claim 1, wherein said oil shoe shining polish contains 5.about.20 volume % of oil ingredient, and its set temperature range is 60.about.80.degree. C., and the set time is 3.about.10 minutes.

3. The apparatus of either claim 1, further comprising:

a shoe detection means for detecting whether or not the shoe is accommodated on the shoe accommodating plate; and a running guide means which engages the forward and backward moving member on an upper side and has a forward and backward guide rod longitudinally formed at both sides in forward and backward directions for guiding forward and backward movements of the forward and backward moving member, with the forward and backward moving member being equipped with an upright cover member in which the center upper surface sponge roller being rotatable in left and right directions at an upper lower end in an angle shape of which a lower end is hinged to be rotatable in forward and backward directions, with a first rotation motor being engaged at one side of the center upper surface sponge roller, with the upright cover member being elastically supported by means of two springs in forward and backward directions; and left and right arm members which are longitudinally provided at left and right sides in forward and backward directions, with their rear ends being freely rotatable in left and right directions, with the left and right side surface sponge rollers being vertically rotatable at a front side end, with second rotation motors being engaged at lower sides of the left and right side surface sponge rollers, with side cover members being provided at outer sides of the left and right side surface sponge rollers, and with the left and right arm members being elastically supported by means of two springs.

4. The apparatus of claim 2, further comprising:

a shoe detection means for detecting whether or not the shoe is accommodated on the shoe accommodating plate; and a running guide means which engages the forward and backward moving member on an upper side and has a forward and backward guide rod longitudinally formed at both sides in forward and backward directions for guiding forward and backward movements of the forward and backward moving member, with the forward and backward moving member being equipped with an upright cover member in which the center upper surface sponge roller being rotatable in left and right directions at an upper lower end in an angle shape of which a lower end is hinged to be rotatable in forward and backward directions, with a first rotation motor being engaged at one side of the center upper surface sponge roller, with the upright cover member being elastically supported by means of two springs in forward and backward directions; and left and right arm members which are longitudinally provided at left and right sides in forward and backward directions, with their rear ends being freely rotatable in left and right directions, with the left and right side surface sponge rollers being vertically rotatable at a front side end, with second rotation motors being engaged at lower sides of the left and right side surface sponge rollers, with side cover members being provided at outer sides of the left and right side surface sponge rollers, and with the left and right arm members being elastically supported by means of two springs.

5. The apparatus of claim 1, wherein said shoe shining polish supply means includes:

a shoe shining polish storing container which stores an oil shoe shining polish and has a pumping means for pumping an oil shoe shining liquid;

a pumping operation means for operating the pumping means of the shoe shining polish storing container; and a shoe shining transfer line which is branched into three parts at its intermediate portion for thereby supplying the oil shoe shining polish pumped from the shoe shining polish storing container into an interior of the oil shoe shining polish and toward the center upper surface sponge roller and the left and right side surface sponge rollers, respectively.

6. The apparatus of claim 1, wherein said high temperature air supply means includes:

a suction fan which is provided in an inner side of the air inlet of the casing for forcibly sucking an external air;

an air transfer tube for transferring the external air sucked by the suction fan into the inner side;

a heating coil member which is provided in a coil shape surrounding an outer side of the air transfer tube for resistant-heating depending on a power supply; and a high temperature air transfer tube which is longitudinally extended from the air transfer tube and is branched into three parts at an intermediate portion for transferring a high temperature air into an inner side while distributing a high temperature air via the spraying nozzle from the front upper surface and the left and right sides of the shoes.

7. The apparatus of claim 2, wherein said oil ingredient is one among mink oil, castor bean oil and jojoba oil or a combination of the same.

8. The apparatus of claim 1, further comprising a shoe shape member which is formed in a shape of a human foot and is inserted into an interior of the shoe and is heated so that an original shape of the shoe is recovered.

9. The apparatus of claim 1, wherein after the oil shoe shining polish is coated, a first coated oil shoe shining polish is heated and dried by means of the high temperature air supply means, and the oil shoe shining polish is coated second, and a second coated shoe shining polish is heated and dried by the high temperature air supply means.

* * * * *